United States Patent [19]

Jeninga

[11] Patent Number: 4,493,503

[45] Date of Patent: Jan. 15, 1985

[54] GOLF BALL RETRIEVER

[76] Inventor: John Jeninga, 114 Wisconsin St., Delavan, Wis. 53115

[21] Appl. No.: 529,169

[22] Filed: Sep. 2, 1983

[51] Int. Cl.[3] ..... A63B 47/02

[52] U.S. Cl. ..... 294/19 A

[58] Field of Search ..... 294/19 A, 19 R, 20, 294/21, 99 R, 110 R, 110 A, 164; 273/162 E, 32 B

[56] References Cited

U.S. PATENT DOCUMENTS

| | | | |
|---|---|---|---|
| 724,814 | 4/1903 | Cohen | 294/19 A |
| 3,401,970 | 9/1968 | Russell | 294/19 A |

*Primary Examiner*—James B. Marbert

*Attorney, Agent, or Firm*—Andrus, Sceales, Starke & Sawall

[57] ABSTRACT

The golf ball retriever includes an inverted, generally U-shaped frame having a pair of opposed legs connected by an intermediate reach. A pair of transversely opposed, generally U-shaped bail members are pivotally mounted between the opposed legs of the frame. The bail members are engageable with a stop provided on at least one of the frame legs and which defines a normal position for the members. The bail members are freely pivotal from the normal position to pass a golf ball therebetween into the retriever, and thereafter under their own weight to return to the normal position to entrap the golf ball in the retriever.

7 Claims, 5 Drawing Figures

GOLF BALL RETRIEVER

NATURE AND SUMMARY OF THE INVENTION

This invention relates to a ball retrieving device and more particularly to a golf ball retriever.

The applicant is the patentee of U.S. Pat. No. 4,046,413 for a Golf Ball Retriever.

According to the present invention a golf ball retriever is provided with a frame having longitudinally spaced, opposed frame portions. A pair of transversely opposed, generally U-shaped bail members are pivotally mounted to the frame between the opposed frame portions. The bail members are engageable with a stop provided on the frame and which define a normal position for the members. The bail members are freely pivotal from said normal position to pass a golf ball therebetween into the retriever, and thereafter under their own weight to return to the normal position to entrap the golf ball in the retriever.

DESCRIPTION OF THE DRAWING FIGURES

The drawings furnished herewith illustrate the best mode presently contemplated for the invention and are described hereinafter.

DESCRIPTION OF THE ILLUSTRATED EMBODIMENTS

Figure 1:
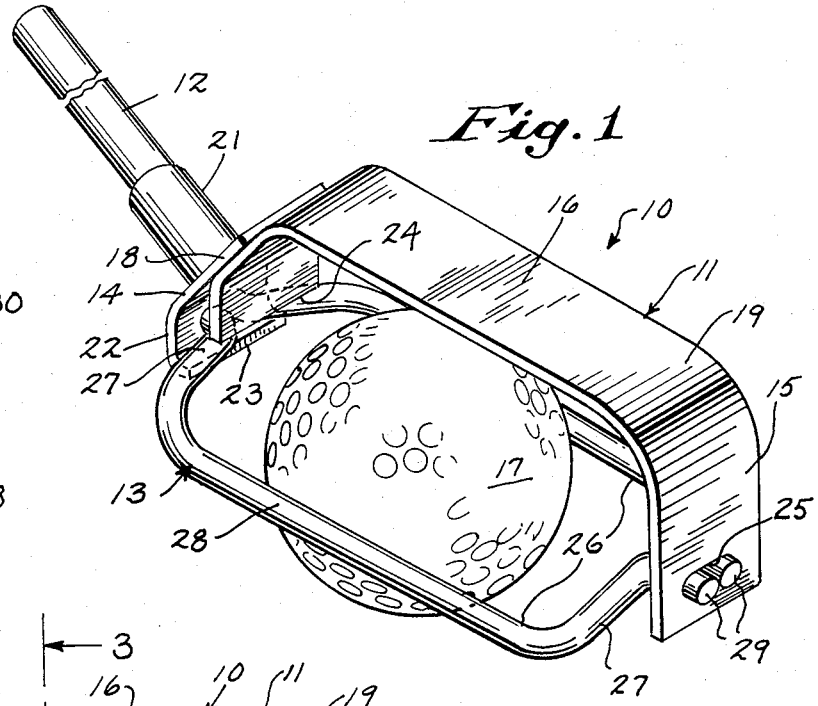
FIG. 1 is a perspective view of the golf ball retriever of this invention and shows a golf ball entrapped therein.

Referring to the drawings, the golf ball retriever 10 of this invention generally includes a frame assembly 11 supported by a handle 12 and in turn supporting a ball entrapping mechanism 13. While the handle 12 is shown only in part, it may be of a common type which is telescopically extendable to provide a substantial reach and collapsible for convenient storage.

The frame assembly 11 may be made of metal or plastic strap and comprises an inverted, generally U-shaped assembly having a pair of longitudinally spaced legs 14 and 15 connected by an intermediate, generally straight reach 16. The intermediate reach 16 is substantially longer than the diameter of a golf ball 17. The leg 15 disposed forwardly extends generally normal to the reach 16.

The frame assembly 11 includes a pair of elements 18 and 19, with the element 19 providing the intermediate reach 16 and the forward leg 15. The frame element 18 overlaps outwardly with the element 19 to form the leg 14 disposed rearwardly. A fastener 20 extends through the overlapped frame elements 18 and 19 to engage the generally rearwardly extending handle fitting 21 to secure the frame elements together and the fitting relative to the frame assembly 11.

Beneath the handle fitting 21, the frame element 18 is provided with a leg portion 22 that generally parallels the forward leg 15 and terminates with an inwardly directed flange 23 generally normal to the leg portion 22. The end 24 of frame element 19 is spaced inwardly from frame element 18 and above the flange 23.

The rear leg portion 22 and forward leg 15 are provided with longitudinally aligned, transversely extending slots 25. The longitudinally opposed slots 25 carry a pair of transversely opposed, generally U-shaped bail members 26 having opposed leg portions 27 connected by the generally straight intermediate reach 28. The respective ends of each bail member 26 are provided with a longitudinally extending journal 29 which are pivotally disposed in the opposed slots 25.

Figure 3:
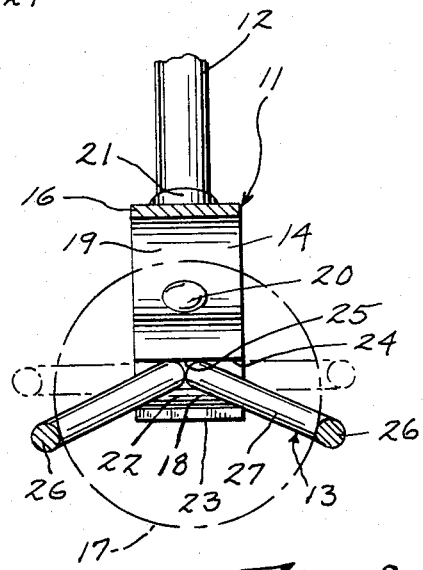
FIG. 3 is a sectional view taken generally on line 3—3 of FIG. 2, and in phantom lines shows an entrapped golf ball therein and the ball trapping mechanism in open position.
Figure 4:
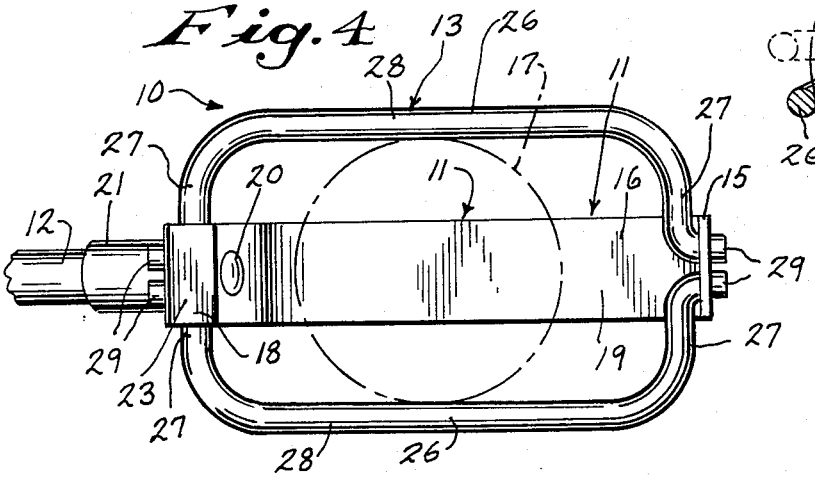
FIG. 4 is a bottom plan view of the retriever with an entrapped golf ball shown in phantom lines.

The bail members 26 are preferably made of metal so that the weight thereof will cause the members to assume their normal lower position when the retriever 10 is oriented with the frame 11 disposed upwardly as generally shown in FIG. 3. In their normal lower position, the rear leg portions 27 of the respective bail members 26 come to rest upon the frame flange 23 and the distance between the reaches 28 of the opposed bail members is less than the diameter of a golf ball 17. Thus, a golf ball 17 in the retriever 10 will come to rest on the opposed bail members 26 with the reaches 28 engaging the ball somewhat beneath the plane containing the horizontal diameter of the ball as illustrated in FIG. 3. The distance between the intermediate reach 16 of the frame assembly 11 and the respective intermediate reaches 28 of the bail members 26 is less than the diameter of a golf ball 17 so that a ball in the retriever 10 cannot fall out even with rotation of the retriever about a longitudinal axis.

The bail members 26 are freely pivotal in their frame assembly mounting with FIG. 3 showing in phantom lines the position of maximum travel for the bail members when the leg portions 27 thereof engage against the stop formed by the end 24 of the frame element 19. In their position of maximum travel or pivot, the intermediate reaches 28 of the bail members 26 are a maximum distance apart, and that distance exceeds the diameter of a golf ball 17 as clearly shown in FIG. 3. Thus, by manually or physically pivoting the bail members 26 from their normal position shown in FIG. 3, a trapped ball 17 is released and free to fall from the retriever 10. Alternatively, if the retriever 10 is rotated about a longitudinal axis 180° from the orientation of FIG. 3, the bail members 26 will fall under their own weight against the stops 24 to open the retriever and provide for easy manual removal of a ball 17.

Figure 2:
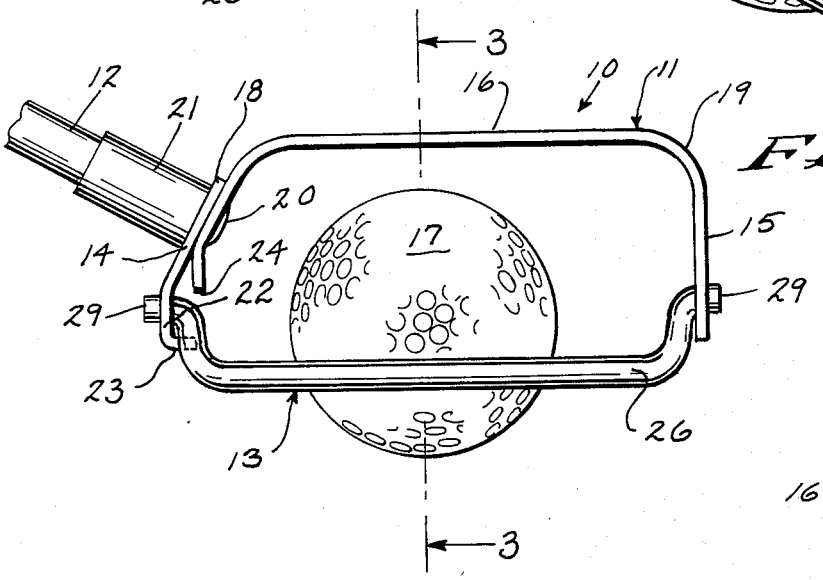
FIG. 2 is an elevational view of the retriever with an entrapped ball therein.

In service, the ball retriever 10 is oriented as generally shown in FIGS. 1–3 and lowered over the ball 17. As the retriever 10 engages over the ball 17 and continues to move downwardly either under its own weight or due to force imposed through the handle 12, one or both of the bail members 26, starting from their normal lower or closed position generally shown in FIG. 3, pivot upwardly or spread apart progressively at least adequately to pass the ball therebetween. With the ball 17 resting on a relatively hard or dense surface and after the maximum diameter of the ball 17 has passed through or between the opposed bail members 26, the members 26 are thereafter free to return under their own weight to their normal or closed position with further downward movement of the retriever 10 to entrap the ball.

Even if an errant ball 17 is substantially buried in dense material such as sand or even muck of a consistency preventing the bail members 26 from falling or pivoting to a closed position under their own weight, retrieval is readily accomplished. To retrieve a substantially buried ball 17 in relatively dense material or a relatively heavy muck, the retriever is forced down over the ball until the ball approaches or touches the overlying reach 16 of the frame assembly 11. Thereafter, upon the initial lifting movement imposed upon the retriever 10, the bail members 26 will be forced to pivot downwardly to closure position to entrap the ball because of the resistance imposed on the bail members by the material thereabove.

If an errant ball 17 is resting in a water hazard within reach of the retriever 10, retrieval with relative ease may be contemplated even while the distance to the ball is somewhat distorted by refraction. The substantial length of the retriever 10 relative to the size of the ball 17 will permit a misjudgment of distance at least within the limits of such distortion.

Figure 5:
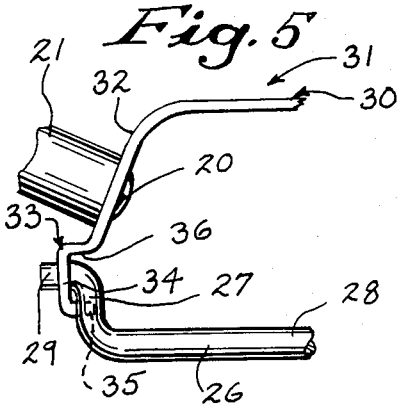
FIG. 5 is a partial elevational view and shows an embodiment of the golf ball retriever wherein the frame is a single-piece member.

According to the embodiment of FIG. 5, the inverted, U-shaped frame 30 of the retriever 31 comprises a single-piece member. The rear leg 32 of the frame 30 is provided with an offset portion 33 beneath the handle fitting 21. The offset portion 33 includes a leg portion 34 that generally parallels the forward leg 15, not shown, and which contains the transversely extending slot 25 for pivotally mounting the rear end of the opposed bail members 26. The bail members 26 in FIG. 5 are pivotally movable between a lower closure position for entrapment of a golf ball 17 as provided by the inwardly directed flange 35 and a maximum open position as provided by the vertically opposed wall 36. In service, the retriever 31 operates similarly to the retriever 10 of FIGS. 1–4.

Various modes of carrying out the invention are contemplated as being within the scope of the following claims particularly pointing out and distinctly claiming the subject matter which is regarded as the invention.

I claim:

1. In a golf ball retriever, a frame having longitudinally spaced, opposed frame portions, and a pair of transversely opposed, generally U-shaped bail members pivotally mounted to the frame between the opposed frame portions, said bail members being engageable with a stop provided on said frame to define a normal position for said members, and said bail members being pivotal from said normal position to pass a golf ball therebetween into the retriever and thereafter being pivotal under their own weight to return to normal position to entrap the golf ball in the retriever.

2. The structure as set forth in claim 1 wherein handle means are attached to the frame.

3. The structure as set forth in claim 1 wherein the U-shaped bail members comprise longitudinally spaced legs connected by an intermediate reach, said legs having longitudinally projecting journals for the pivotal mounting of the opposed bail members to the frame.

4. The structure as set forth in claim 3 wherein the opposed frame portions are provided with longitudinally aligned, transversely extending slots for pivotally receiving the journals of the transversely opposed bail members.

5. The structure as set forth in claim 3 wherein the frame has a generally inverted U-shaped configuration comprising longitudinally spaced legs connected by an intermediate reach, said intermediate reach of the frame being spaced a distance less than the diameter of a golf ball from the intermediate reach of the respective bail members.

6. The structure as set forth in claim 1 wherein the frame comprises a generally inverted U-shaped assembly having a pair of longitudinally spaced legs connected by an intermediate reach, a first element of the frame assembly forming one of the legs and the intermediate reach of the assembly, a second element overlapping outwardly the first element to form the other leg of the frame assembly, fastener means securing the overlapping frame elements together, and wherein said stop defining the normal position of said bail member comprises an inwardly directed flange on the end of said second frame element, said first frame element terminating in spaced relation above the flange to form a second stop engageable by the bail members, said second stop defining the position of maximum travel for the pivotal bail members.

7. The structure as set forth in claim 1 wherein the frame comprises a single-piece, generally inverted U-shaped member having a pair of longitudinally spaced legs connected by an intermediate reach, one of the legs of the frame member having an outwardly projecting offset portion pivotally mounting one end of the bail members, and wherein said stop defining the normal position of the bail members comprises an inwardly directed flange on the end of said leg beneath the offset portion, said leg further including a portion above the offset portion and generally paralleling the flange to form a second stop engageable by the bail members, said second stop defining the position of maximum travel for the pivotal bail members.

* * * * *